US009637686B2

(12) United States Patent
Remesat et al.

(10) Patent No.: US 9,637,686 B2
(45) Date of Patent: May 2, 2017

(54) PROCESS FOR TREATING MINED OIL SANDS DEPOSITS

(71) Applicant: Canadian Natural Resources Limited, Calgary (CA)

(72) Inventors: Darius Simon John Remesat, Calgary (CA); Alvaro Blanco, Calgary (CA)

(73) Assignee: CANADIAN NATURAL RESOURCES LIMITED, Calgary, Alberta (CA)

( * ) Notice: Subject to any disclaimer, the term of this patent is extended or adjusted under 35 U.S.C. 154(b) by 177 days.

(21) Appl. No.: 14/255,459

(22) Filed: Apr. 17, 2014

(65) Prior Publication Data

US 2014/0311952 A1 Oct. 23, 2014

Related U.S. Application Data

(60) Provisional application No. 61/813,356, filed on Apr. 18, 2013.

(30) Foreign Application Priority Data

Apr. 19, 2013 (CA) ..... 2819073

(51) Int. Cl.

| | |
|---|---|
| ***C10G 1/00*** | (2006.01) |
| ***C10G 1/02*** | (2006.01) |
| ***C10G 1/06*** | (2006.01) |
| ***C10G 67/04*** | (2006.01) |
| ***C10G 1/04*** | (2006.01) |
| ***C10G 21/00*** | (2006.01) |

(52) U.S. Cl.

CPC ..... *C10G 1/002* (2013.01); *C10G 1/045* (2013.01); *C10G 21/003* (2013.01); *C10G 67/049* (2013.01)

(58) Field of Classification Search

CPC ..... C10G 1/002; C10G 1/045; C10G 21/003; C10G 67/049; E21C 41/00; E21C 41/10; E21C 41/26; E21C 41/31

See application file for complete search history.

(56) References Cited

U.S. PATENT DOCUMENTS 3,684,689 A * 8/1972 Patton ..... C10B 55/10 208/127
6,007,709 A * 12/1999 Duyvesteyn ..... C10G 1/047 208/390

(Continued)

OTHER PUBLICATIONS

Shu, W.R., A Viscosity Correlation for Mixtures of Heavy Oil, Bitumen, and Petroleum Fractions, Society of Petroleum Engineers Journal, 1984, pp. 277-282.*

*Primary Examiner* — Renee Robinson
*Assistant Examiner* — Derek Mueller
(74) *Attorney, Agent, or Firm* — Kilpatrick Townsend & Stockton LLP

(57) ABSTRACT

Disclosed is a method for improving a heavy hydrocarbon, such as mined bitumen, to a lighter more fluid product and, more specifically, to a hydrocarbon product that is refinery-ready and that meets pipeline transport criteria without requiring the addition of diluent. The invention is suitable for enhancing recovery from mined Canadian bitumen, but has general application for processing any heavy hydrocarbon, converting the heavy hydrocarbon to a product that is more suitable for pipeline transport.

18 Claims, 4 Drawing Sheets

(56) References Cited

U.S. PATENT DOCUMENTS

| | | | | |
|---|---|---|---|---|
| 6,054,496 | A * | 4/2000 | Crane | C10G 21/003 137/13 |
| 2006/0283776 | A1 * | 12/2006 | Iqbal | C10G 21/003 208/86 |
| 2009/0314681 | A1 * | 12/2009 | Marchionna | C10G 67/049 208/57 |

* cited by examiner

PROCESS FOR TREATING MINED OIL SANDS DEPOSITS

CROSS-REFERENCE TO RELATED APPLICATIONS

This is a non-provisional of U.S. Provisional Appl. No. 61/813,356, filed Apr. 18, 2013, and further claims priority to Canadian Application No. 2,819,073, filed Apr. 19, 2013, both of which are incorporated herein by reference in their entireties.

FIELD OF THE INVENTION

The invention relates to a method for improving a heavy hydrocarbon to a lighter more fluid product and, more specifically, to a hydrocarbon product that is refinery-ready and that meets pipeline transport criteria without requiring the addition of diluents.

BACKGROUND

Refining of sweet crude resources requires less capital input and less cost expenditure than processing heavy sour crudes. However, the processing of heavy sour crude has become an increasingly important option to meet the world's demand for hydrocarbon-based fuels. Heavy sour crude may be derived from bitumen. Bitumen is a form of petroleum that exists in the semi-solid or solid phase in natural deposits. Bitumen is a thick, sticky form of crude oil, having a viscosity greater than 10,000 centipoises under reservoir conditions, an API gravity of less than 10° API and typically contains over 15 wt % $C_5$-asphaltenes.

Most, if not all, commercial upgraders for processing heavy crude have been built to convert heavy viscous hydrocarbons into crude products that range from light sweet to medium sour blends. Heavy oil upgraders basically achieve this conversion by using high intensity conversion processes. These processes may release up to 20% by weight of the feedstock as a coke byproduct and another 5% as off-gas product. Alternatively, these processes require significant hydro-processing such as ebullated bed hydrocracking and fixed bed hydro-treating to maximize the conversion of the heavy components in the feedstock to lighter, lower sulfur liquid products.

Various processes have been used to convert and/or condition oil sands bitumen into pipeline transportable and refinery acceptable crude. Of note, thermal cracking, catalytic cracking, solvent deasphalting and various combinations thereof (for example, visbreaking and solvent deasphalting) have been proposed to convert bitumen to hydrocarbon streams having characteristics suitable for pipeline transport and use as a refinery feedstock. Some examples of these methodologies are presented below.

In U.S. Pat. No. 4,454,023 ("the '023 patent"), a process for the treatment of heavy viscous hydrocarbon oil is disclosed. The process involves the steps of: visbreaking the oil; fractionating the visbroken oil; solvent deasphalting the non-distilled portion of the visbroken oil in a two-stage deasphalting process to produce separate asphaltene, resin, and deasphalted oil fractions; mixing the deasphalted oil ("DAO") with the visbroken distillates; and recycling and combining resins from the deasphalting step with the initial feedstock. While the '023 patent provides a means for upgrading lighter hydrocarbons (API gravity>15), the API of a typical composition of Canadian bitumen is lower than this. In addition, thermal cracking will generally result in over-cracking and coking of the hydrocarbon stream. There is added complexity and cost associated with the two-stage solvent deasphalting system (e.g. separation of the resin fraction from the deasphalted oil, and recycling of the resin stream).

U.S. Pat. No. 4,191,636 describes a process in which heavy oil is continuously converted into asphaltenes and metal-free oil. The process involves hydrotreating the heavy oil to crack asphaltenes selectively and remove heavy metals such as nickel and vanadium simultaneously. The liquid products are separated into a light fraction and a heavy fraction of an asphaltene- and heavy metal-containing oil. The light fraction is recovered as a product and the heavy fraction is recycled to the hydrotreating step. It is not clear whether this process would be effective for the catalytic conversion of Canadian bitumen (API gravity<10).

Accordingly, there is an on-going need to develop cost-effective and efficient ways to process heavy hydrocarbons such as Canadian bitumen.

While there have been various processes disclosed for separating and treatment of a hydrocarbon feed source, there is still a need to identify processes that are suitable for handling heavy hydrocarbon feeds, such as Canadian bitumen. The present invention provides a low complexity, low severity, yet reliable operational procedure to separate and convert Canadian bitumen to produce a pipelineable product without the need for external diluent. The methods disclosed herein achieve this result by performing a lower complexity separation than typically used, while minimizing the conversion steps typically seen in producing refinery-type streams (e.g. minimizing the conversion steps decrease the complexity with a corresponding decrease in cost). In this way, much of the virgin portion of the feed bitumen can be used in the final product blend.

Current processes used in industry include combinations of diluent recovery (DRU)+vacuum distillation (VDU)+delayed coking+hydrotreating and/or DRU+VDU+heavy oil stripper+residue hydrocracking+hydrotreating and/or some combination of the first two. These processes produce a synthetic crude oil with API's above 30 which requires more processing than what is required to be sent in pipelines. The process according to an embodiment of the present invention yields a 19-21 API product (which meets pipeline specification) from a less complex process.

SUMMARY OF THE INVENTION

According to a first aspect of the invention, a process is provided for converting a heavy hydrocarbon stream into a pipelineable product, said process comprising:

(a) using a froth treatment process to separate bitumen present in the heavy hydrocarbon stream from water creating a solvent/bitumen stream and a water-rich stream;

(b) extracting the solvent/bitumen stream to generate multiple product streams comprising:
  i) a bitumen bottoms stream;
  ii) a virgin heavy vacuum gas oil stream;
  iii) a light virgin vacuum gasoil stream; and
  iv) a light virgin atmospheric gas oil stream;

(c) converting, in a conversion unit, a portion of the heavy vacuum gas oil stream and/or bitumen bottoms obtained from step (b) to produce a stream of lighter hydrocarbons; and (d) blending a portion or all of the virgin heavy vacuum gas oil stream, the light virgin vacuum gasoil stream, the light virgin atmospheric gas oil stream from step (b)

and the stream of lighter hydrocarbons produced in step (c) to create a pipelineable product.

Preferably, the process further comprises the step of recovering solvent from step (b) for reuse in the froth treatment step. Also preferably, the conversion is performed thermally and/or catalytically.

Preferably, the process further comprises the step of mining bitumen-rich soil deposits to obtain the bitumen for the process. More preferably, the process further comprises the extraction of bitumen from soil deposits using a water extraction process to create a water/bitumen stream and a soil rich stream; and forwarding the water/bitumen stream to the froth treatment process of step (a).

Preferably, the pipelineable product has over 20 vol % of 950° F. (510° C.) and heavier boiling range material and less than 15 vol % of 350° F. (177° C.) and lighter boiling range material.

Preferably, the process further comprises the addition of heavier heavy virgin gas oil to the stream in the conversion unit during the conversion step (c). Also preferably, the process further comprises the addition of light virgin gas oil to the stream in the conversion unit during the conversion step (c).

According to another aspect of the invention, a process is provided for converting mined bitumen into a pipelineable product, the process comprising:

(a) adding hot water to the mined bitumen to obtain a heavy hydrocarbon stream;
(b) separating the bitumen in the heavy hydrocarbon stream bitumen from the water using a paraffinic solvent to create a solvent/bitumen stream and a water stream containing asphaltenes and solids;
(c) extracting the solvent/bitumen stream from step (b) to generate two product streams comprising:
  i) a heavy bitumen stream; and
  ii) a light virgin atmospheric gas oil stream;
(d) distilling the heavy bitumen stream in (c) to produce
  i) a virgin light vacuum gas oil;
  ii) a heavy vacuum gas oil stream and
  iii) a bottoms stream;
(e) treating a portion of the heavy vacuum gas oil stream in a fixed bed hydrocracker to produce a stream of lighter hydrocarbons;
(f) blending the light virgin atmospheric gas oil stream from step (c), the first virgin light vacuum gas oil from step (d), a portion of the heavy vacuum gas oil stream; and the stream of lighter hydrocarbons from step (e) to create a pipelineable product.

Preferably, the pipelineable product has over 20 vol % of 950° F. (510° C.) and heavier boiling range material and less than 15 vol % of 350° F. (177° C.) and lighter boiling range material.

Preferably, the process further comprises a step to process a portion of the bottoms stream from step (d) through the use of a solvent deasphalting unit to create an additional stream to be sent to the hydrocracker.

Preferably, the process further comprises adjusting the amount of heavy virgin gas oil feed into the fixed bed hydrocracker.

Preferably, the process further comprises adjusting the amount of a light virgin gas oil feed into the fixed bed hydrocracker.

Preferably, the process further comprises the recovery of the solvent from step (c) for reuse in the process.

According to another aspect of the invention, a process is provided for producing a pipelineable product from mined bitumen, the process comprising:

(a) adding hot water to the mined bitumen to obtain a heavy hydrocarbon stream;
(b) separating the bitumen in the heavy hydrocarbon stream from the water using a naphtha-based solvent to create a solvent/bitumen stream and a water stream containing asphaltenes;
(c) extracting the solvent/bitumen stream to generate a heavy bitumen stream and a light virgin atmospheric gas oil stream;
(d) distilling the heavy bitumen stream produced in step (c) in a solvent deasphalting unit to produce a virgin deasphalted oil stream and a heavy bitumen bottoms stream containing asphaltenes and solids;
(e) processing the heavy bitumen bottoms stream obtained in step (d) in a thermal conversion unit to remove solids and produce a stream of lighter hydrocarbons;
(f) processing a portion of the stream of lighter hydrocarbons produced in step (e) in a hydrotreating unit to produce a stream of hydrotreated lighter hydrocarbons;
(g) blending the light virgin atmospheric gas oil stream, the virgin deasphalted oil stream, the stream of lighter hydrocarbons and the stream of hydrotreated lighter hydrocarbons to create a pipelineable product.

Preferably, pipelineable product has over 20 vol % of 950° F. (510° C.) and heavier boiling range material and less than 10 vol % of 350° F. (177° C.) and lighter boiling range material.

Preferably, the solids removed at step (d) are further processed in a metals recovery unit to recover precious metals such as vanadium, and titanium.

According to one aspect, a process for converting heavy crude oils to a lighter hydrocarbon crude is disclosed. The heavy crude may be an type of bitumen, preferably mined Canadian Oil Sands bitumen, or steam-assisted well-based bitumen (e.g. SAGD sourced bitumen). The light crude produced from the process is suitable for pipeline transport and can be used as a refinery feedstock. The process generally consists of the following steps:

(a) feeding a bitumen-rich stream (25) to a froth treatment process (30) to produce a substantially water-free diluted bitumen stream (35);
(b) separating (40) diluted bitumen to recover the diluent (43) for reuse in the froth treatment process and to produce
  i) a light hydrocarbon component (41) for direct product blending (1);
  ii) a virgin atmospheric gas oil (45) for direct product blending (1);
  iii) a heavy vacuum gas oil or a combination of virgin light and heavy vacuum gas oils (49); and
  iv) a bitumen bottoms component (47) for direct product blending (1);
(c) converting the heavy vacuum gas oil or combination from (b)(iii) to produce a product (65) for blending (1); and
(d) blending of the product streams (b)(i), (b)(ii), (b)(iv) and (c) to produce a final product (95).

The final product (95) is blended to meet pipeline specifications. Pipeline specifications typically include but are not limited to viscosity of less than or equal to 300 cSt at ambient conditions, basic sediment and water (BS&W) of less than or equal to 0.5 vol % and no olefins measured in the product.

Optionally, the process further comprises processing a portion of stream (65) in a dehexanizer to generate make-up solvent for froth treatment and sending the remaining product from the dehexanizer to product blending (1).

As a person skilled in the art would appreciate, there may be additional processing steps included in the process. For example, optionally, preceding the fixed bed hydrocracking, there may be a solvent deasphalting step (e.g. carried out in a SDA unit) to extract heavy gas oils from the bottoms resulting from the vacuum step.

The light hydrocarbon stream produced as a result of step (b) can be used directly for product blending because generally the light hydrocarbon stream meets pipeline specifications (e.g. less than 350 cSt). Removing the light hydrocarbons after stage (b) of the process described above is useful because their presence would add unnecessary volume to the subsequent steps. Also, this light hydrocarbon could be degraded in the subsequent steps.

According to a second aspect, a process for converting heavy crude oil to a lighter hydrocarbon crude is disclosed. The starting heavier crude may be bitumen, such as Canadian Oil Sands bitumen. The final product is generally ready for pipeline transport and to be used as a refinery feedstock. The process comprises:

(a) treating a bitumen-rich stream using a paraffinic froth treatment process (230);
(b) introducing the treated stream from (a) into a diluent recovery column (240) to produce:
  (i) a virgin atmospheric gasoil for direct product blending (245);
  (ii) a stream (247)
(c) recycling solvent from the diluent recovery column back to the paraffinic froth treatment process;
(d) separating stream (247) to produce:
  (i) light virgin vacuum gasoil (259)
  (ii) heavy virgin vacuum gasoil (251); and
  (ii) a bottoms stream (257);
(e) forwarding the light virgin vacuum gasoil and a portion of the heavy virgin vacuum gasoil to product blending (2);
(f) converting a portion of the heavy virgin vacuum gasoil using a fixed bed hydrocracker (260);
(g) forwarding a lighter hydrocarbon stream (265) and a remaining uncoverted heavy vacuum gasoil stream (269) from the hydrocracker for direct product blending (2);
(h) blending streams (245), (251), (259), (257) and (269) to produce a product (295).

As a person skilled in the art would appreciate, additional steps may be incorporated into the above procedure. For example, there may be a dehexanizer unit following the fixed bed hydrocracking. As a person skilled in the art would appreciate, step (d) may be carried out in a vacuum distillation unit.

According to another aspect, there is provided a method similar to that outlined in the second aspect above, but further comprising using a solvent deasphalting unit (SDA) after separating step (240). Products resulting from the SDA treatment may be used to extract additional gasoils for hydrocracking and for direct product blending.

According to yet another aspect of the invention, there is provided a method to produce a lighter hydrocarbon fraction from a heavy crude, the method comprising:

(a) using a naphthenic froth treatment (430) to produce a stream (435);
(b) removing stream (435) to a diluent recovery unit to recover and recycle diluent (443) for froth treatment;
(c) producing a virgin atmospheric gasoil (445) for direct product blending;
(d) producing a stream of heavy bitumen (447) for treatment in a solvent deasphalting unit (450);
(e) removing a portion of the stream from the solvent deasphalting unit to direct product blending (495);
(f) removing a portion of the stream from the solvent deasphalting unit to a coking process (460);
(g) removing a portion of the stream from the coking process to hydrotreating;
(h) blending streams (445), (457) and (475) to produce a product (4).

As with the other processes described here, the product meets pipeline specifications. As well, there may be additional steps. For example, there may be additional product streams generated from the SDA process to generate additional products such as asphalt blending feedstock.

In all of the processes described herein, ideally, solvent is recycled to the froth treatment unit to avoid the production of diluted bitumen and to ensure the appropriate streams are produced for product blending. Solvent recycling also contributes to the economic efficiency of the entire process. The solvent can be recycled after the extraction of the solvent/bitumen stream, and solvent recycling can be incorporated at various other points in the processes described.

BRIEF DESCRIPTION OF THE DRAWINGS

Several aspects of the present invention are illustrated by way of example, and not by way of limitation, in detail in the figures, wherein.

DETAILED DESCRIPTION

Figure 1:
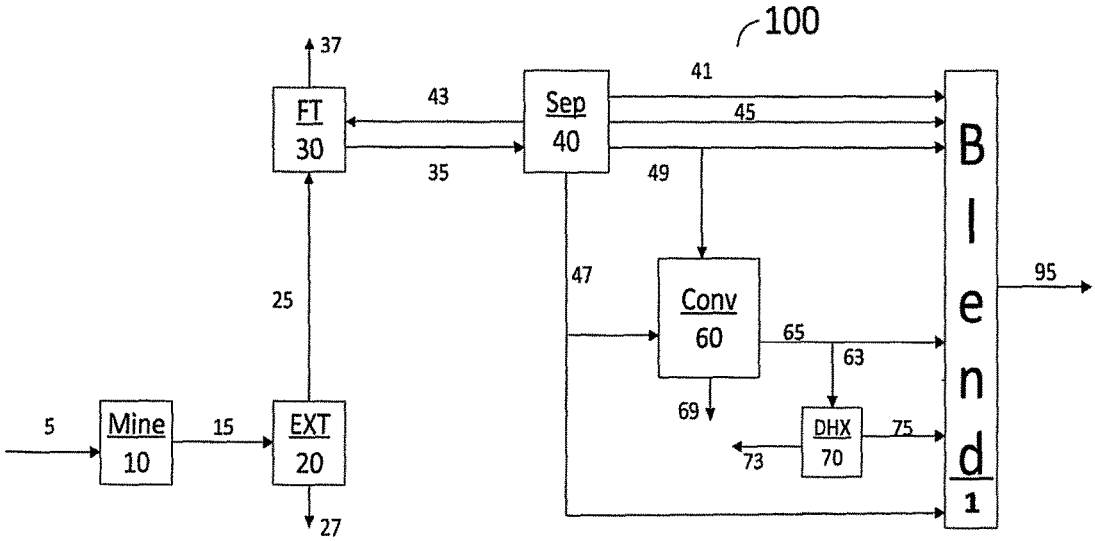
FIG. 1 is an illustrative process diagram for forming a pipeline transportable hydrocarbon product from a mined bitumen deposit.

The detailed description set forth below, in conjunction with FIGS. 1 to 4, is intended as a description of various embodiments of the present disclosure and is not intended to represent the only embodiments contemplated by the inventors. The detailed description includes specific details for the purpose of providing a comprehensive understanding of the present disclosure. However, it will be apparent to those skilled in the art that the present processes may be practiced using substitutions.

DEFINITIONS

As used throughout this disclosure, the following terms have the meanings set out below:

"Asphaltenes" are complex structured hydrocarbons found within bitumen and conventional heavy oils consisting primarily of carbon, hydrogen, nitrogen, oxygen, and sulfur, as well as trace amounts of vanadium and nickel, with their boiling range above 950° F. The Carbon to Hydrogen ratio is approximately 1:1.2, and are defined operationally as the n-pentane or n-heptane insoluble component of a carbonaceous material such as crude oil, bitumen, or coal.

"Naphtha" is a portion of bitumen (and crude oil) that consists of hydrocarbons having carbon numbers in the range of $C_5$-$C_{12}$, with a boiling point typically below 350° F. API's for this fraction of the bitumen are considered to be above 65.

"Distillate" is a portion of the bitumen and crude that consists of hydrocarbons having carbon numbers in the range of $C_{10}$ to $C_{18}$ with a boiling point typically between 350° F. and 500° F. API's for this fraction of the bitumen are considered to be between 35 and 65.

"Gasoils" are a portion of the bitumen and crude that consist of hydrocarbons having carbon numbers in the range of $C_{15}$ to $C_{30}$ with a boiling point typically between 500° F. and 950° F. API's for this fraction of the bitumen are considered to be between 10 and 35. Gasoils can be further categorized as atmospheric (270-650° F. boiling range), light vacuum (752-850° F.) and heavy vacuum (850-975° F.). The atmospheric gas oil is typically produced in a refinery or upgrader through atmospheric distillation. The light and heavy vacuum gasoils are typically produced through vacuum distillation.

"Bitumen bottoms" are a portion of the crude that consists of the heaviest hydrocarbons having carbon numbers typically above $C_{28}$ with a boiling point typically above 950° F. This refers to the portion of the bitumen remaining once the gasoil fractions have been removed. API's for this fraction of the bitumen are considered to be typically below 10.

The term "atmospheric" comes from the technique used to isolate this hydrocarbon from the main stream. "Light virgin atmospheric gas oil" boils in the lower range of the atmospheric gasoil boiling range, hence the light descriptor. This is a 270-650° F. boiling range material.

The term "vacuum" comes from the technique (Vacuum tower) used to isolate this hydrocarbon from the main stream. "Virgin heavy vacuum gasoil" can also be called heavy virgin gasoil. It boils in the upper range of the vacuum gasoil boiling range, hence the heavy descriptor. This is a material boiling between 850-975° F. "Light virgin vacuum gasoil" boils in the lower range of the vacuum gasoil boiling range, hence the light descriptor. This is a 752-850° F. boiling range material.

"Virgin" (or "straight run") in refining refers to the crude or bitumen molecules that have not been thermally or catalytically converted. These molecules have simply been separated (e.g. via distillation or solvent extraction) from the bulk hydrocarbon stream for use in the product blend.

"Diluent" is a light hydrocarbon, typically in the naphtha boiling range (API above 65, viscosity below 1 cSt at 40° C.). It is used as a blending component to reduce the viscosity of heavier hydrocarbons.

"Pipeline specification" usually means that the flowing material has minimal solids (e.g. <800 wppm), is less than or equal to 0.5 vol % of Basic Sediment and Water (BS&W) has a viscosity of less than or equal to 350 cSt at ambient conditions, and has no detectable olefins in the product blends.

"Substantially water free" means that there is less than about 1.5 percentage (by volume) in the stream or mixture in question.

The methods relate to combining hydrocarbon streams produced at various stages and by various means in a hydrocracking process to produce a pipeline suitable product. As will be described below, using the processes of this invention, a specific, selective, and small portion of the bitumen (e.g. heavy vacuum gas oils) is catalytically treated to generate lighter hydrocarbons in the distillate and naphtha boiling range. These lighter hydrocarbons are blended with the remaining virgin bitumen to meet pipeline specifications. As an added feature of some of the processes described herein, the product distribution can be tailored. For example, this can be accomplished by: a) adjusting the feed to the fixed bed hydrocracker (e.g. adding heavier heavy vacuum gas oil (HVGO); b) by adjusting operation of the vacuum; and/or c) by adding light vacuum gas oil (LVGO) into the base HVGO feed. By adjusting in this way, the hydrocracker output changes to match the product distribution of other fungible heavy crudes such as Maya and Alaska North Slope. This in turn increases the marketability of this product.

Overall, the processes described in this disclosure retain a large portion of the overall original bitumen as pipelineable product with minimal asphaltene rejection. There is generally over 100% of product yield downstream of the distillation step (e.g. downstream of the diluent recovery unit (DRU) shown in FIGS. 1 to 3). This is because the processes described herein allow for full use of the virgin bitumen product resulting from the distillation step. For the processes described herein, there is no need to add external diluent to the processed stream to meet pipeline specification for transport.

In the processes described herein, the heavy portion of the virgin bitumen stream (vdu bottoms) is blended with gas oils before being mixed with the lighter hydrocarbons (e.g. napthas). The mixing of the heavy portion of the virgin bitumen stream with the gas oil assists in preventing precipitation of asphaltenes in the heavy bitumen stream that would otherwise occur when mixing with lighter components. The gasoils act as a buffer and/or neutralizer and/or dilution agent to counter the effect of the lighter hydrocarbons. Generally, when the naphtha:vdu bottoms ratio is below 1:1, precipitation will be minimized. Alternatively, when the naphtha to (vdu bottoms+gasoils) is below 1:1, precipitation will be minimized. The presence of gasoils serves to allow more naphtha to be added without precipitation issues.

A person skilled in the art would appreciate that the source of bitumen for the process described above could be derived from a mining operation. Typical mining operations used to extract Canadian bitumen mine the oil sands deposit from depths less than about 150 feet. Other sources of bitumen are possible. Generally, the bitumen found to be effectively treated in the process of the invention is Canadian oil sands bitumen. Once the bitumen is mined, the bitumen is generally treated in a hot water bitumen extraction unit. It is this bitumen-rich stream that is the feedstock of the process described above. The bitumen-rich stream is subject to a froth treatment process (step (a) above). Froth treatment processes are generally known in the art, and could be conducted in a froth treatment unit (high temperature $C_5$-$C_6$ paraffinic or lower temperature napthlenic).

A person skilled in the art would appreciate that various equipment could be used to carry out the steps enumerated in the processes described herein. For example, a vacuum distillation and diluent columns may be used for distilling/separating steps.

The process will now be described with reference to the specific embodiments illustrated in FIGS. 1 to 4.

FIG. 1 is a process flow diagram depicting a process 100 for forming a hydrocarbon pipelineable product 95 from an oil sand hydrocarbon feedstock 5. A mine operation 10 is required to dig the oil sands out from the deposit of clay, rock and sand. The solid oil sand, clay, rock and sand mixture 15 is transported from the mine to extraction unit 20. In extraction unit 20, hot water is added to separate the oil sands from the clay, rock and sand to produce a flowable liquid stream 25. The rock, clay, sand, and residual bitumen/water is sent back to the mine as stream 27.

Stream 25 is fed to a froth treatment unit 30, where a light hydrocarbon solvent, such as naphtha boiling range hydrocarbons, is added to separate water from the bitumen. Stream 37, along with residual water from the extraction process, is returned to the mine 10 via tailings pond. Stream 35, consisting of bitumen and solvent, is then sent to separation unit 40. In separation unit 40, distillation, extraction, stripping or other separation methods may occur. Stream 43 is solvent which is returned to froth treatment unit 30.

From separation 40, multiple intermediate streams may be produced depending on processing objectives. Stream 41 can be a combination of naphtha and distillate boiling range materials for use directly as native diluent in the product blend 1. Stream 45 can be a virgin atmospheric gas oil (VAGO) which meets pipeline specification and can be sent directly to product blending 1. Alternatively, a combination of atmospheric and light vacuum gasoil (LVGO) can be produced and sent directly for product blending.

Stream 49 may be heavy vacuum gas oil (HVGO) or a combination of virgin light vacuum gasoil and heavy vacuum gas oils. A portion of stream 49 is sent to conversion unit 60 and the remainder is sent directly to product blending 1. Stream 47 has the remaining heavy bitumen (bitumen bottoms) and can be sent for further processing. A portion of stream 47 is available for feed to the conversion unit 60 and the remainder sent for product blending 1. Conversion unit 60, whether thermal or catalytic, produces a suite of lighter hydrocarbons (such as naphtha, distillate and light vacuum gas oil boiling range components), shown as stream 65. Stream 65 is used directly for product blending 1. Stream 69, arising from conversion unit 60, can either be a solid by-product (e.g. coke) or a heavy slurry for gasification. Alternatively, stream 69 may be used in the product blend, depending on conversion technology used. Conversion unit 60 is meant to represent a generic conversion unit and may be a coking apparatus or a catalytic converter, for example. Coking is a thermal process, and generates coke which can't be used in the product blend while the catalytic conversion type (hydrocracking) has the potential to produce all of the products that can be used in the product blend.

Stream 63 is sent to dehexanizer unit 70. In dehexanizer unit 70, make-up solvent is produced as stream 73 for use in froth treatment unit 30. The remaining material, stream 75, is sent to product blending.

As a person skilled in the art would appreciate, dehexanizer unit 70 is optional. Also, there may be various solvent recycling steps incorporated in the process. Product blending 1 is a mixture of streams 41, 45, 49, 47, 65 and 75. The result is a pipeline suitable product 95.

Figure 2:
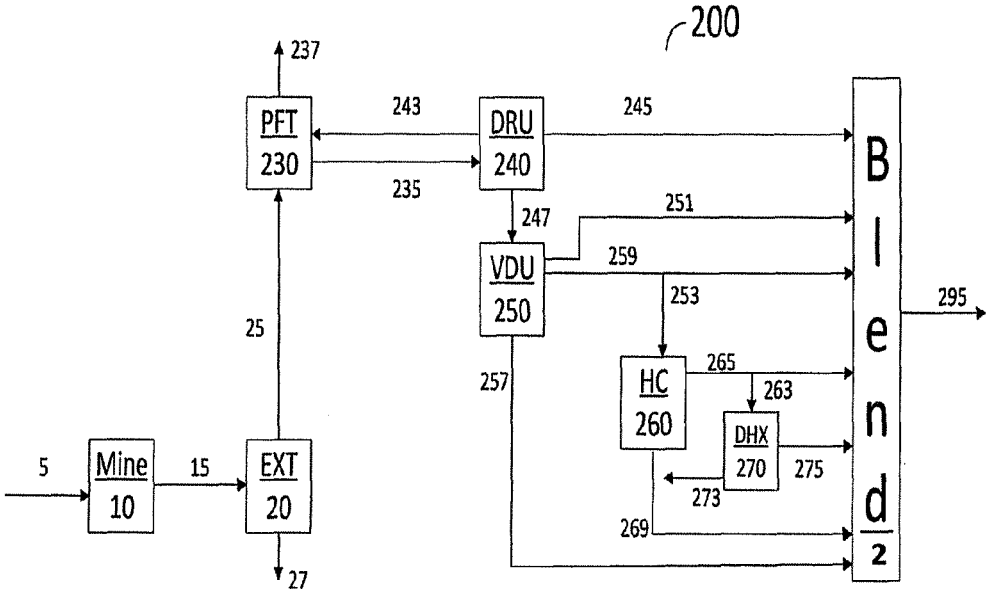
FIG. 2 is a process diagram for forming a pipeline transportable hydrocarbon product from a mined bitumen deposit using paraffinic froth treatment.

FIG. 2 is a process flow diagram depicting a process 200 for forming a hydrocarbon pipelineable product 295 from oil sand-based solid hydrocarbon feedstock 5. The feedstock 5 is derived from mine operation 10. Mine operation 10 is required to dig the oil sands out from the deposit of clay, rock and sand. The solid oil sand, clay, rock and sand mixture 15 is transported from mine 10 to extraction unit 20. In extraction unit 20, hot water is added to separate the oil sands from the clay, rock and sand and produce a flowable liquid stream 25. The rock, clay, sand, and residual bitumen/water is sent back to the mine as stream 27.

Stream 25 is fed to paraffinic froth treatment unit 230 where a $C_5$, or $C_6$ solvent or a mixture of the two is added to separate the water from the bitumen in stream 25. Stream 237 is returned to mine 10 via tailings pond(s). Stream 237 includes residual water from the extraction process, nearly all the entrained solids and a large portion of the asphaltenes from the bitumen feedstock 5.

Stream 235, consisting of bitumen and paraffinic solvent, is sent to diluent recovery unit (DRU) 240. DRU 240 returns the paraffinic solvent in stream 243 and produces two streams: 1) stream 245 is virgin atmospheric gasoil (VAGO) which is sent directly to product blending 2; and 2) stream 247, containing the remaining heavy bitumen, is sent for further processing. Stream 243 contains solvent which is recycled back to paraffinic froth treatment (230).

Stream 247 is sent to a vacuum distillation unit 250. In vacuum distillation unit 250, virgin vacuum gasoils (VVGO) are separated into a heavy vacuum gas oil stream 259 and a light vacuum gas oil stream 251, with a residual bitumen bottoms stream 257. Stream 253 is the portion of the heavy vacuum gas oil used as feed to the hydrocracker 260. Stream 251 goes to product blend 2.

A vacuum column 250 (such as a vacuum distillation unit 250) is used to extract more of the gasoils from the bottoms 247 without requiring a higher temperature than the DRU (240). The use of high temperature would create unwanted coke and light gases. Some of stream 259 may be sent directly to product blend 2 and/or a portion or all of stream 259 is used as feed to fixed bed hydrocracker 260 to generate lighter hydrocarbons for the product blend. If more HVGO material is needed, the vacuum unit operation may be adjusted to allow some LVGO into stream 259. It is expected that fixed bed hydrocracker 260 will operate in approximate ranges of 750-820° F., 800-1750 psi of hydrogen partial pressure and liquid hourly space velocities (LHSV) of 0.5-3.0.

A fixed bed hydrocracker is a simpler and more robust hydroprocessing unit then an ebullated bed hydrocracker. Ebullated bed hydrocrackers run up to 2,700 psi of hydrogen partial pressure for Athabasca bitumen. Fixed bed hydrocracker 260 produces a suite of lighter hydrocarbons primarily including the stream 265 (consisting of naphtha, distillate and light vacuum gas oil boiling range components) for product blending. In addition, stream 269 leaves unit 260 as unconverted heavy vacuum gas oil from the feed stream 259.

Stream 263 sent to dehexanizer unit 270 where paraffinic solvent is produced as stream 273 for use as make-up in the paraffinic froth treatment unit 230. The remaining material, stream 275 is sent to product blending to generate stream 295.

Figure 3:
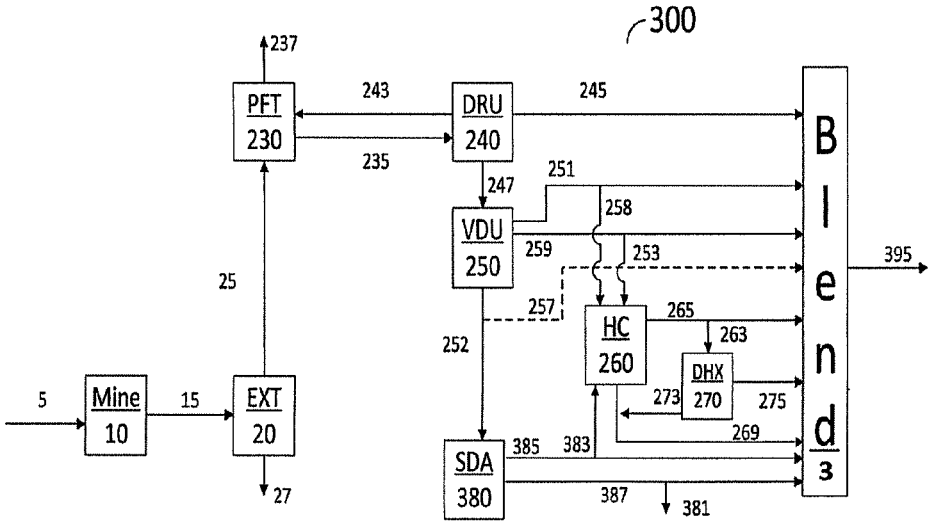
FIG. 3 is a process diagram showing an alternate embodiment to the process diagram in FIG. 2.

FIG. 3 shows process 300, an alternate embodiment of process 200 shown in FIG. 2. In this arrangement, a solvent deasphalting unit (SDA) 380 is added subsequent to the vacuum distillation unit 250. If more gasoil is required than what the vacuum unit can typically provide in meeting pipeline specification the SDA serves to provide a cleaner (e.g. less metals) and heavier feedstock to the hydrocracker (260) to ensure the reliability of the hydrocracker.

As a person skilled in the art would appreciate, the hydrocracker is fed gasoils and the vacuum column generates a side product that will not have appreciable asphaltenes in the gasoil stream. The SDA extracts more gasoils out of the bitumen in the event a larger hydrocracker is needed. These gasoils are more difficult to separate cleanly from the bitumen in vacuum distillation. To resolve this, the SDA 380 is used. The remaining products from the SDA 380, streams 385 and 387 are still primarily sent to product blending, thus maintaining a high product yield. Stream 385 is termed deasphalted oil, the lighter portion of the feed to the SDA. Stream 387 is an asphaltene-rich heavier stream, typically called pitch. Stream 383 is a portion of Stream 385 that provides an additional feed source to the hydrocracker, unit 260. Whatever material from 385 that is not used as stream 383, will be sent to product blending. In the event the blended product does not meet pipeline specification, a portion of the pitch in stream 387 can be diverted to another disposition, labeled stream 381. A disposition can be a thermal cracker, but ideally there is normally no flow in stream 381 so the overall yield of the process is maximized. Ideally, the operation of the SDA 380 should not extract too many resins into the DAO stream 385 so that the asphaltenes in stream 387 do not prematurely precipitate when re-blended with the lighter virgin streams previously separated.

Both processes 200 and 300 provide a crude feedstock that meets pipeline specifications and which is suitable for high conversion refiners. Streams 295 and 395 both have low proportions of diluent/naphtha (<20 vol %), with substantial VGO range material (>20% of crude). For high conversion refiners (>1.4:1 conversion to coking), the distillation quality of the crude produced in streams 295 and 395 will improve utilization of the highest profit-generating units while filling out the remaining units.

Figure 4:
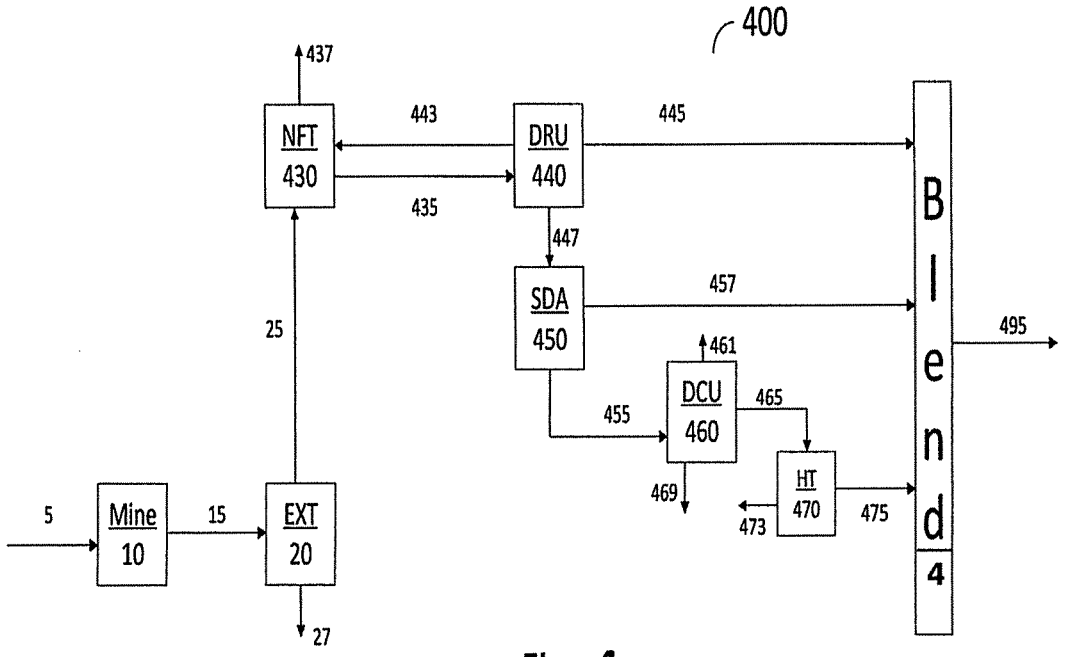
FIG. 4 is a process diagram for forming a pipeline transportable hydrocarbon product from a mined bitumen deposit using naphthenic froth treatment.

FIG. 4 is a process flow diagram depicting a process 400 for forming a hydrocarbon pipelineable product 495 from oil sand-based solid hydrocarbon feedstock 5. A mine operation, 10 is required to dig the oil sands out from the deposit of clay, rock and sand. The solid oil sand, clay, rock and sand mixture 15 is transported from the mine to the extraction unit 20. In extraction unit 20, hot water is added to separate the oil sands from the clay, rock and sand and make it into a flowable liquid stream 25. The rock, clay, sand, and residual bitumen/water is sent back to the mine as stream 27. Stream 25 is fed to the naphthenic froth treatment unit 430, where a hydrocarbon with an approximate ideal boiling range of 150° F.-235° F. (naphtha boiling range) is added to the bitumen/water mixture to separate the water from the bitumen. Stream 437 is returned to the mine 10 via tailings pond(s) with residual water from the extraction process.

Stream 435 takes the bitumen and naphtha-based solvent to the diluent recovery unit (DRU) 440. The DRU returns the naphtha-based solvent in stream 443 and produces two streams: 1) stream 445 is virgin atmospheric gasoil sent direct to product blending; and 2) stream 447, containing the remaining heavy bitumen, is sent for further processing to a solvent deasphalting unit (SDA) 450. Two streams are generated from SDA 450. Stream 457 contains the lighter portion of the feed stream, noted as deasphalted oil (DAO) and is sent to product blending. The second stream 455, containing concentrated asphaltenes and solids, is sent to coking unit 360.

Coking unit 360 thermally cracks the heavy asphaltene-based feed stream into lighter hydrocarbons such as naphtha, distillate and gasoil range liquid hydrocarbons for use in the final product blend to meet viscosity pipeline specification. These hydrocarbons are collected as stream 465 and sent to a hydrotreating unit 470. Byproducts of the coking unit include coke, unwanted solids, metals and "burned" heavy hydrocarbons shown as stream 469 and light "non-condensable" hydrocarbons 461, which are directed to a fuel gas system.

Stream 469 could be further treated in a metals recovery unit to extract valuable material such as titanium and vanadium. A mild hydrotreating operation with low hydrogen consumption (<750 scf/bbl) is employed on stream 465 to simply saturate any olefins generated in the coking unit to meet pipeline specification without removing sulfur and nitrogen species. The hydrotreated product stream 475 is shared between streams 473 and stream 475. Stream 475 is added to the product blend to create the final product stream 495. Stream 473 can be used as solvent make-up for the froth treatment unit 430 and/or the SDA unit 450 depending on the specifications for these units. Of note, stream 495 has low metals content and % CCR (e.g. Conradson ConCarbon Residue—a measure or coking precursors in the stream) for a pipelineable crude that meets viscosity specifications.

In the naphthenic froth treatment process shown in FIG. 4, a downstream unit is generally preferred to handle the solids (clays, sands) that remain with the bitumen prior to blending for pipeline use. In FIG. 4, the coking unit handles solids, and also serves to generate lighter hydrocarbons in the distillate and naphtha boiling range. These hydrocarbons blend with the remaining virgin bitumen to meet pipeline specifications. Similar to the scheme shown in FIG. 2, the product distribution can be adjusted to match the distribution of other fungible heavy crudes such as Maya and Alaska North Slope. This increases the marketability of this product. Overall, this process creates over 90% of product yield downstream of the diluent recovery unit.

Processes 200 and 300 were compared to a process similar to process 300, but using a commercially available ebullated bed reactor instead of a fixed bed reactor. The ebullated bed reactor is based on information in Hydrocarbon Processing's, Refining Processes 2011 Handbook (Gulf Publishing Company) where the ebullated bed reactor is a reactor with an expanded catalyst bed (not fixed) maintained in turbulence by liquid upflow to achieve expected operation. Intermittent catalyst addition and withdrawal are features that differentiate ebullated bed from a fixed bed hydrocracker. The ebullated bed operates between 725-840° F., 1,000-2,700 psig hydrogen partial pressure, and LSHV of 0.1-0.6. Table 1 provides the feed stream used in the analysis. In Table 2, a summary of flow rates (measured in kilos of standard barrels per day (kBPSD) is shown when an ebullated hydrocracker is compared to a fixed bed hydrocracker used for unit 260.

As shown in Table 3, the yield for the ebullated bed process is 90% due to the rejection of asphaltenes in the SDA to gasification or fuel. Also, the ebullated bed approach requires a complicated, tough to operate hydrocracking unit to accomplish the necessary light hydrocarbon generation. In processes 200 and 300, the yields are approximately 105-106% post DRU since the bottoms pitch can be used in the product blend. In the upstream paraffinic froth unit, up to 66% of the asphaltenes or 12% of the bitumen from the mine will be returned to the mine. As a result, the bottoms of the product blend have a reduced quantity of asphaltenes and thus less light hydrocarbon is needed to meet the pipeline viscosity specification. All of the remaining bottoms can be used in the product blend increasing the overall yield of the pipelineable product. In addition, more of the barrel remains as product, thereby reducing the emissions generated. Also, the way the bitumen barrel is segregrated between units 230 and 260, allows for a simpler, more dependable hydroprocessing unit (fixed bed hydrocracker) to be used improving the overall economics of the operation.

TABLE 1

| Feed Properties | |
|---|---|
| Gravity, ° API (at 15° C.) | 8.5-10.5 |
| Sulfur, wt % | ~4.2 |
| Nitrogen, wt % | ~0.32 |
| Conradson Carbon Residue, wt % | 9.7 |

TABLE 1-continued

| Feed Properties | |
|---|---|
| Distillation, V % | |
| IBP-350° F. | 0 |
| 350-650° F. | 14.9% |
| 650-975° F. | 44.4% |
| 975° F. | 40.7% |

TABLE 2

Summary of Flowrates

| | Flowrate, kBPSD | |
|---|---|---|
| | Ebullated case | 200, 300, 400 |
| Bitumen to Crude Still | 100 | 100 |
| AGO and SCO Blending | 20.8 | 20.8 |
| Total Atmospheric residue | 79.2 | 79.2 |
| Atmospheric residue bypassed | 23.7 | 0 |
| Atmospheric residue to VDU | 55.5 | 79.2 |
| VGO to SCO blending | 16.5 | 10.4 |
| Vacuum Residue to SDA | 39 | 0-12.4 |
| Vacuum Residue to Blend | 0 | 0-28.4 |
| HVGO to Fixed Bed HC | 0 | 24-28 |
| SDA Asphaltenes to Glasification or fuel | 12 | 0 |
| SDA asphaltenes to blend | 0 | 0-6.4 |
| Hydroprocessing Products | 29.2 | 30-41 |
| Total SCO or pipelineable product | 90.8 | 90-106.8 |
| Hydrogen Required, MMSCFD | 54.4 | 50-76.6 |
| Syngas Export from Gasifier, MM Btu/day | 48,500 | 0 |

TABLE 3

Product yields (100,000 BPSD Feed to DRU)

| | units | Ebullated Case | Process 200 FIG. 2 | Process 300 FIG. 3 | Process 400 FIG. 4 |
|---|---|---|---|---|---|
| Total Product | BPD | 90837.00 | 106830.00 | 105300.00 | 89466.67 |
| Yield on Crude | % | 90.80 | 106.80 | 105.30 | 89.47 |
| Gravity | °API | 20.40 | 21.70 | 19.80 | 21.20 |
| Viscosity @ 7° C. | cSt | <350 | <350 | <350 | <350 |
| Sulfur | wt % | 2.50 | 3.20 | 3.50 | 3.00 |
| Nitrogen | wt % | 0.24 | 0.27 | 0.29 | 0.21 |
| Conradson Carbon Residue | wt % | 5.30 | 7.00 | 7.30 | 1.98 |
| Nickel + Vanadium | wppm | 99.00 | 170.00 | 177.00 | 30.10 |
| Distillation | | | | | |
| IBP-350° F. | V % | 7.80 | 5.50 | 4.50 | 7.70 |
| 350-650° F. | V % | 30.60 | 41.80 | 36.70 | 19.60 |
| 650-975° F. | V % | 40.90 | 20.10 | 20.10 | 47.80 |
| 975° F. | V % | 20.70 | 32.60 | 38.70 | 24.90 |

It is to be understood that other aspects of the present disclosure will become readily apparent to those skilled in the art from the following detailed description, wherein various embodiments are shown and described by way of illustration. As will be realized, there are many other and different embodiments, and the details provided herein are capable of modification in various other respects, all without departing from the spirit and scope of the present disclosure. Accordingly, the drawings and detailed description are to be regarded as illustrative in nature and not as restrictive.

We claim:

1. A process for converting a heavy hydrocarbon stream into a pipelineable product, said process comprising:

(a) using a froth treatment process to separate bitumen present in the heavy hydrocarbon stream from water creating a solvent/bitumen stream and a water-rich stream;

(b) separating the solvent/bitumen stream to generate multiple product streams comprising:

i) a bitumen bottoms stream;

ii) a virgin heavy vacuum gas oil stream;

iii) a light virgin vacuum gasoil stream; and iv) a light virgin atmospheric gas oil stream;

(c) converting, in a conversion unit, a portion of the heavy vacuum gas oil stream and/or bitumen bottoms obtained from step (b) to produce a stream of lighter hydrocarbons; and (d) blending a portion or all of the virgin heavy vacuum gas oil stream, the light virgin vacuum gasoil stream, the light virgin atmospheric gas oil stream from step (b) and the stream of lighter hydrocarbons produced in step (c) to create a pipelineable product, wherein the pipelineable product has over 20 vol % of 950° F. (510° C.) and heavier boiling range material.

2. The process of claim 1, further comprising recovering solvent from step (b) for reuse in the froth treatment step.

3. The process of claim 1, wherein the conversion is performed thermally.

4. The process of claim 1, wherein the conversion is performed catalytically.

5. The process of claim 1, further comprising mining bitumen-rich soil deposits to obtain the bitumen for the process.

6. The process of claim 5, further comprising: extracting bitumen from soil deposits using a water extraction process to create a water/bitumen stream and a soil rich stream; and forwarding said water/bitumen stream to the froth treatment process of step (a).

7. The process of claim 1, where the pipelineable product has less than 15 vol % of 350° F. (177° C.) and lighter boiling range material.

8. The process of claim 1, further comprising adding heavy virgin gas oil to the stream in the conversion unit during the conversion step (c).

9. The process of claim 8, further comprising adding light virgin gas oil to the stream in the conversion unit during the conversion step (c).

10. A process for converting mined bitumen into a pipelineable product, the process comprising:

(a) adding hot water to the mined bitumen to obtain a heavy hydrocarbon stream;

(b) separating the bitumen in the heavy hydrocarbon stream from the water using a paraffinic solvent to create a solvent/bitumen stream and a water stream containing asphaltenes and solids;

(c) separating the solvent/bitumen stream from step (b) to generate two product streams comprising:

i) a heavy bitumen stream; and ii) a light virgin atmospheric gas oil stream;

(d) distilling the heavy bitumen stream in (c) to produce i) a virgin light vacuum gas oil; ii) a heavy vacuum gas oil stream and iii) a bottoms stream;

(e) treating a portion of the heavy vacuum gas oil stream in a fixed bed hydrocracker to produce a stream of lighter hydrocarbons;

(f) blending the light virgin atmospheric gas oil stream from step (c), the first virgin light vacuum gas oil from step (d), a portion of the heavy vacuum gas oil stream; and the stream of lighter hydrocarbons from step (e) to create a pipelineable product, wherein the pipelineable product has over 20 vol % of 950° F. (510° C.) and heavier boiling range material.

11. The process of claim 10, wherein the pipelineable product has less than 15 vol % of 350° F. (177° C.) and lighter boiling range material.

12. The process of claim 10, further comprising a step to process a portion of the bottoms stream from step (d) through the use of a solvent deasphalting unit to create an additional stream to be sent to the hydrocracker.

13. The process of claim 10, further comprising adjusting the amount of heavy virgin gas oil feed into the fixed bed hydrocracker.

14. The process of claim 10, further comprising adjusting the amount of a light virgin gas oil feed into the fixed bed hydrocracker.

15. The process according to claim 10, further comprising the recovery of the solvent from step (c) for reuse in the process.

16. A process for producing a pipelineable product from mined bitumen, the process comprising:

(a) adding hot water to the mined bitumen to obtain a heavy hydrocarbon stream;

(b) separating the bitumen in the heavy hydrocarbon stream from the water using a naphtha-based solvent to create a solvent/bitumen stream and a water stream containing asphaltenes;

(c) separating the solvent/bitumen stream to generate a heavy bitumen stream and a light virgin atmospheric gas oil stream;

(d) processing the heavy bitumen stream produced in step (c) in a solvent deasphalting unit to produce a virgin deasphalted oil stream and a heavy bitumen bottoms stream containing asphaltenes and solids;

(e) processing the heavy bitumen bottoms stream obtained in step (d) in a thermal conversion unit to remove solids and produce a stream of lighter hydrocarbons;

(f) processing a portion of the stream of lighter hydrocarbons produced in step (e) in a hydrotreating unit to produce a stream of hydrotreated lighter hydrocarbons;

(g) blending the light virgin atmospheric gas oil stream, the virgin deasphalted oil stream, the stream of lighter hydrocarbons and the stream of hydrotreated lighter hydrocarbons to create a pipelineable product, wherein the pipelineable product has over 20 vol % of 950° F. (510° C.) and heavier boiling range material.

17. The process of claim 16, wherein the pipelineable product has less than 15 vol % of 350° F. (177° C.) and lighter boiling range material.

18. The process of claim 16, where the solids removed at step (d) are further processed in a metals recovery unit to recover precious metals.

* * * * *